US006729089B1

(12) United States Patent
Spragg

(10) Patent No.: US 6,729,089 B1
(45) Date of Patent: May 4, 2004

(54) POST ANCHOR

(76) Inventor: Robert J. Spragg, 4241 US 23 North, Alpena, MI (US) 49707

( * ) Notice: Subject to any disclaimer, the term of this patent is extended or adjusted under 35 U.S.C. 154(b) by 89 days.

(21) Appl. No.: 10/210,828

(22) Filed: Jul. 24, 2002

(51) Int. Cl.[7] ..... E02D 27/00; E02D 27/32

(52) U.S. Cl. ..... 52/296; 52/298; 52/731.1; 52/736.1; 248/519; 248/346.03; 256/65.14

(58) Field of Search ..... 52/296, 298, 288.1, 52/677, 699, 712, 731.1, 653.1, 736.1, 736.4, 170; 403/187; 248/519, 523, 346.01, 346.03, 548, 909, 362; 256/65.14

(56) References Cited

U.S. PATENT DOCUMENTS

| | | | | | |
|---|---|---|---|---|---|
| 796,248 | A | | 8/1905 | Rieseck | |
| 1,791,135 | A | | 2/1931 | Kummer | |
| 4,330,971 | A | | 5/1982 | Auberger | |
| 5,000,414 | A | * | 3/1991 | Rosato | 248/524 |
| 5,150,982 | A | | 9/1992 | Gilb | |
| 5,186,571 | A | | 2/1993 | Hentzschel | |
| 5,325,651 | A | | 7/1994 | Meyer et al. | |
| 5,743,505 | A | * | 4/1998 | Sofy | 248/346.01 |
| 5,794,395 | A | * | 8/1998 | Reed | 52/298 |
| 5,832,675 | A | * | 11/1998 | Zuares | 52/60 |
| 6,088,982 | A | * | 7/2000 | Hiesberger | 52/241 |
| 6,336,620 | B1 | * | 1/2002 | Belli | 248/519 |
| 6,467,756 | B1 | * | 10/2002 | Elsasser | 256/65.14 |
| 6,643,982 | B1 | * | 11/2003 | Lapp et al. | 52/127.2 |

* cited by examiner

*Primary Examiner*—Carl D. Friedman
*Assistant Examiner*—Chi Q. Nguyen
(74) *Attorney, Agent, or Firm*—Richard C. Conover

(57) ABSTRACT

A one-piece post anchor for securing a post to a support structure including four identically shaped side members, each member comprising a curvilinear planar member having a concave shape extending from a top edge outwardly to a bottom-edge. The four side members are positioned in a rectangular pattern with the top edges forming a rectangular opening, and the bottom edges forming a rectangularly-shaped base. The base has a cross-sectional area greater than the cross-sectional area of the rectangular opening. Further, four identically shaped interior members are positioned in a rectangular pattern within the rectangular opening to form a rectangular channel through the post anchor. A plurality of support flanges are fastened to each interior member and corresponding side member for additional structural support. Openings are provided in each side member to receive a screw for mounting the post anchor to a post and to the support structure.

3 Claims, 2 Drawing Sheets

POST ANCHOR

BACKGROUND OF THE INVENTION

The present invention relates to a one-piece post anchor for securing an upright post to a support structure such as flooring. Anchor brackets for supporting posts in an upright position are known. See, for example, U.S. Pat. No. 5,150,982 to Gilb; U.S. Pat. No. 5,794,395 to Reed and U.S. Pat. No. 6,088,982 to Hiesberger. All of these devices use an "L"-shaped bracket having one leg secured to the post, and the other leg secured to the flooring or support structure.

The present invention is an improvement over known devices for anchoring posts to support structures. The present invention is of a one-piece design and easy to use. The present invention provides supporting side members which are positioned to form a narrow opening at the top for receiving a post and a wider base area at the bottom for resting on the support surface. The cross-sectional area of the base is larger than the cross-sectional area of the narrow opening at the top. The side members are shaped to resist transverse forces applied to the post. Further, the present invention is lightweight, being constructed of injected molded plastic and includes support flanges mounted to the side walls providing structural support and at the same time eliminating the necessity of solid plastic construction.

SUMMARY OF INVENTION

The present invention includes a one-piece post anchor for securing a post to a support structure including four identically shaped side members, each member comprising a curvilinear planar member having a concave shape extending from a top edge outwardly to a bottom edge. The four side members are positioned in a rectangular pattern with the top edges forming a rectangular opening, and the bottom edges forming a rectangularly-shaped base. The base has a cross-sectional area greater than the cross-sectional area of the rectangular opening. Further, four identically shaped interior members, each having a rectangular planar shape, are positioned in a rectangular pattern within the rectangular opening to form a rectangular channel open at both ends through the post anchor. A plurality of support flanges are fastened to each interior member and corresponding side member for additional structural support. Further, each side member includes at least one opening therethrough for receiving a wood screw for securing the post anchor to the post received by the channel, and at least one opening therethrough for receiving a wood screw for securing the post anchor to the support structure.

DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

A post anchor 10 is shown in FIGS. 1–4. The post anchor 10 includes four upright side members 12*a*, 12*b*, 12*c* and 12*d*. Each of the side members have a curvilinear planar shape and include a concave-shaped exterior surface extending from a top edge 14 to a bottom edge 16. The four side members 12*a*, 12*b*, 12*c* and 12*d* are positioned with their top edges 14 forming a rectangular opening and their bottom edges forming a rectangularly-shaped base. The base having a cross-sectional area greater than the cross-sectional area of the rectangular opening. The abutting edges of adjacent side members are joined together.

The post anchor 10 further includes four upright interior planar members 18*a*, 18*b*, 18*c* and 18*d*. Each of the members 18*a*, 18*b*, 18*c* and 18*d* have a rectangular shape with a top edge and a bottom edge. The four interior members 18*a*, 18*b*, 18*c* and 18*d* are identically shaped, each having a rectangular planar shape with a top edge and a bottom edge. The top edges of the interior member are positioned in a rectangular pattern within the rectangular opening, and the bottom edges form a rectangular opening located at the base. Each interior member is further positioned to face one of the four side members. Each of the four interior members 18*a*, 18*b*, 18*c* and 18*d* are joined to adjacent interior members along their edges, as shown, to form a rectangularly-shaped channel extending through post anchor 10.

Each side member 12*a*, 12*b*, 12*c* and 12*d* is provided with three-flanges 20*a*, 20*b* and 20*c*. The flanges 20*a*, 20*b*, and 20*c* are shaped to extend between a curved sidewall and a respective interior wall, as shown in FIG. 4, and are joined thereto.

Figure 1:
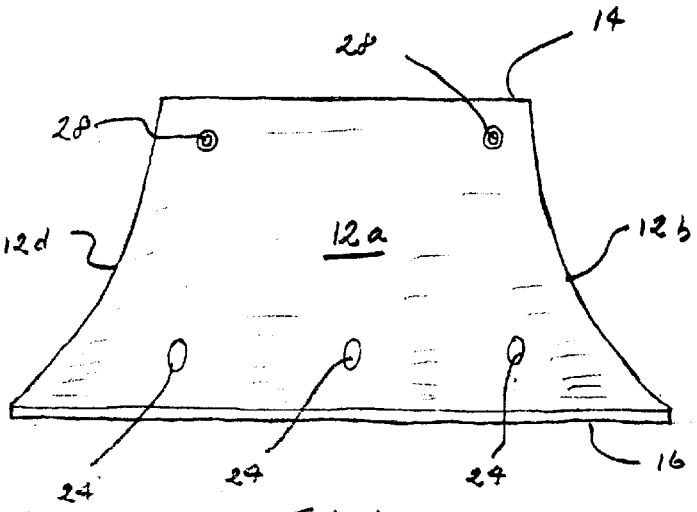
FIG. 1 is an elevational view of a post anchor according to the present invention.
Figure 2:
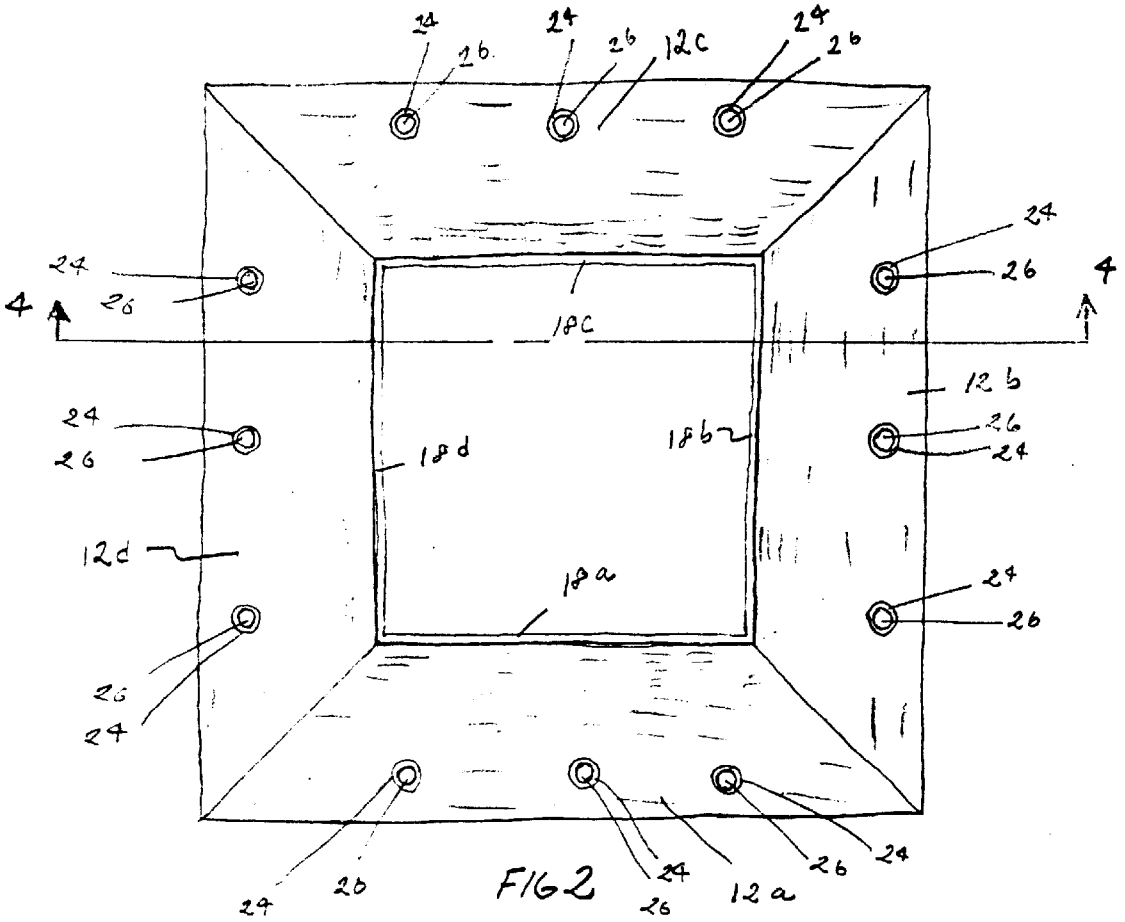
FIG. 2 is a top plan view of the post anchor shown in FIG. 1.
Figure 3:
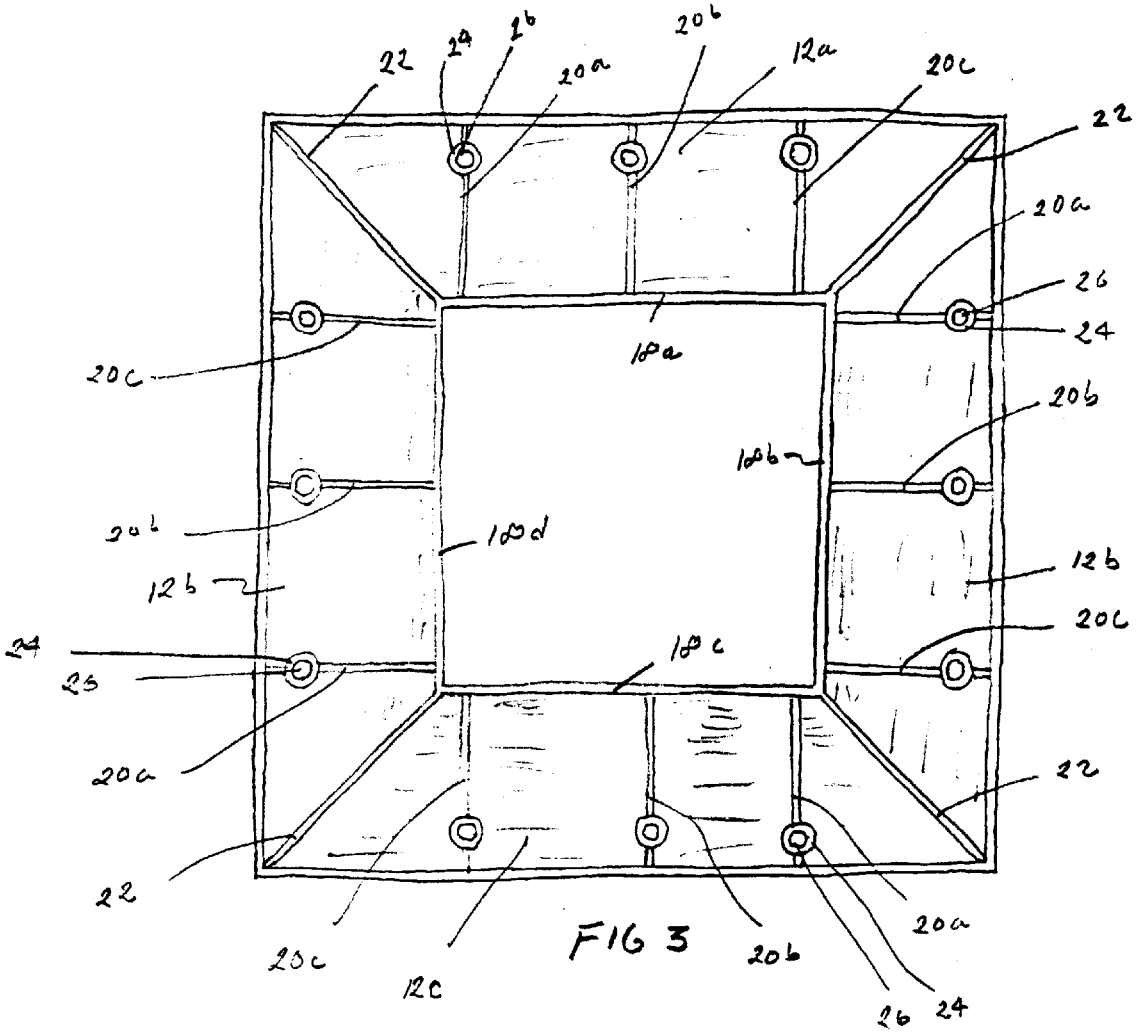
FIG. 3 is a bottom plan view of the post anchor shown in FIG. 1.

Further, as shown in FIG. 3, each corner is provided with a flange 22 which extends between an exterior corner edge of the joined interior walls 18*a*–18*d*, and a respective interior corner edge located between adjacent side members 12*a*–12*d*. The flanges 22 are shaped to fit between the interior members and side members and are joined thereto. Each of the flanges 20 include an enlarged screw receiving member 24, as shown in FIGS. 1–4. The enlarged screw receiving members each have a hole 26, as shown in FIGS. 1 and 3. The members 24 are used to reinforce the screw receiving holes 26.

Figure 4:
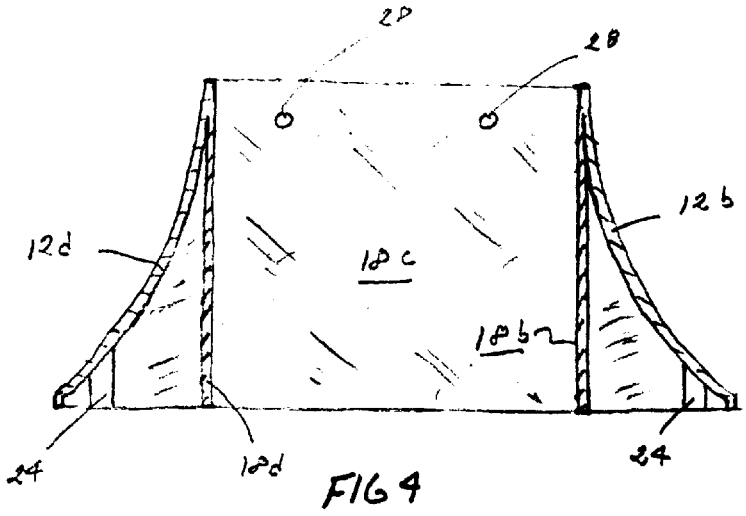
FIG. 4 is a cross-sectional view taken along the line 4—4 in FIG. 1.

Each of the side members 12*a*–12*d* further include a pair of holes 28, as shown in FIGS. 1 and 4, positioned adjacent the top edge 14 of the post anchor 10. Holes 28 extend through both the side members 12*a*–12*d* and the corresponding interior walls 18*a*–18*d*.

In a preferred embodiment, the anchor post 10 is constructed in one-piece using injected molded plastic. In using the present invention, a rectangular-shaped post is positioned through the channel formed by interior walls 18*a*–18*d*. The anchor post 10 is then positioned at a location on the flooring where the post is to be secured. The post is positioned to extend in an upright position and the bottom edge 16 of the anchor post 10 is positioned to rest on the flooring. Screws (not shown) are then screwed into the post through holes 28 located in the side members 12*a*–12*d*. Next, screws (not shown) are screwed into the flooring through'screw holes 26 provided in the side walls 18*a*–18*d* to secure the post to the flooring at a selected position.

While the fundamental novel features of the invention have been shown and described, it should be understood that various substitutions, modifications, and variations may be made by those skilled in the art, without departing from the spirit or scope of the invention. Accordingly, all such modifications or variations are included in the scope of the invention as defined by the following claims.

I claim:

1. A one-piece post anchor for securing a post to a support structure comprising:

four identically shaped side members, each member comprising a curvilinear planar member having a concave shape extending from a top edge outwardly to a bottom edge;

the four side members positioned in a rectangular pattern with the top edges forming a rectangular opening and the bottom edges forming a rectangularly-shaped base;

the base having a cross-sectional area greater than the cross-sectional area of the rectangular opening;

the edges of adjacent side members are abutting joined together;

four identically shaped interior members, each having a rectangular planar shape with a top edge and a bottom edge;

the top edges of the interior member positioned in a rectangular pattern within the rectangular opening, and the bottom edges located at the base to form a rectangular channel open at both ends through the post anchor;

each interior member further positioned to face one of the four side members;

the abutting edges of adjacent interior members are abutting joined together;

a plurality of support flanges extending between each interior member and a corresponding side member; and each side member having at least one opening therethrough for receiving a wood screw for securing the post anchor to the post when a post is inserted into the channel and further having at least one opening therethrough for receiving a wood screw for securing the post anchor to the support structure.

2. The post anchor according to claim 1 further including reinforcement means associated with each opening receiving a wood screw for securing the post anchor to the support structure.

3. The post anchor according to claim 1 wherein the post anchor is constructed in one-piece with injection molded plastic.

* * * * *